US005658173A

United States Patent [19]

Genta

[11] Patent Number: 5,658,173

[45] Date of Patent: Aug. 19, 1997

[54] ELECTRIC CONNECTOR

[75] Inventor: Alessandro Genta, Turin, Italy

[73] Assignee: Framatome Connectors International, Courbevoie, France

[21] Appl. No.: 419,801

[22] Filed: Apr. 11, 1995

[30] Foreign Application Priority Data

Apr. 12, 1994 [IT] Italy ..... TO94A0274

[51] Int. Cl.[6] ..... H01R 13/514

[52] U.S. Cl. ..... 439/752.5; 439/677

[58] Field of Search ..... 439/595, 752.5, 439/733.1, 852, 677, 678, 679, 680

[56] References Cited

U.S. PATENT DOCUMENTS

| | | | |
|---|---|---|---|
| 4,713,026 | 12/1987 | Mobley et al. . | |
| 4,919,628 | 4/1990 | Mobley et al. | 439/852 X |
| 5,190,477 | 3/1993 | Akeda | 439/752.5 X |
| 5,478,244 | 12/1995 | Maue et al. | 439/852 X |
| 5,480,320 | 1/1996 | Saimoto | 439/852 |

FOREIGN PATENT DOCUMENTS

| | | |
|---|---|---|
| A-0-361771 | 4/1990 | European Pat. Off. . |
| 5-190228 | 11/1993 | Japan . |
| 2073505 | 10/1981 | United Kingdom . |

*Primary Examiner*—Khiem Nguyen

*Attorney, Agent, or Firm*—Pollock, Vande Sande & Priddy

[57] ABSTRACT

An electric connector including an insulating case defining a number of axial cavities, and a number of electric terminal housed respectively inside the cavities and each comprising a contact body cooperating with a respective complementary terminal and presenting a box structure defined by four lateral walls, two of which mate with each other along an edge of the box structure. The contact body presents at least one tab extending integrally from one of the aforementioned two walls and bent onto the other, for both enhancing the structural resistance of the box structure and ensuring correct insertion of the terminal inside the respective cavity which presents locating ribs for the purpose.

8 Claims, 2 Drawing Sheets

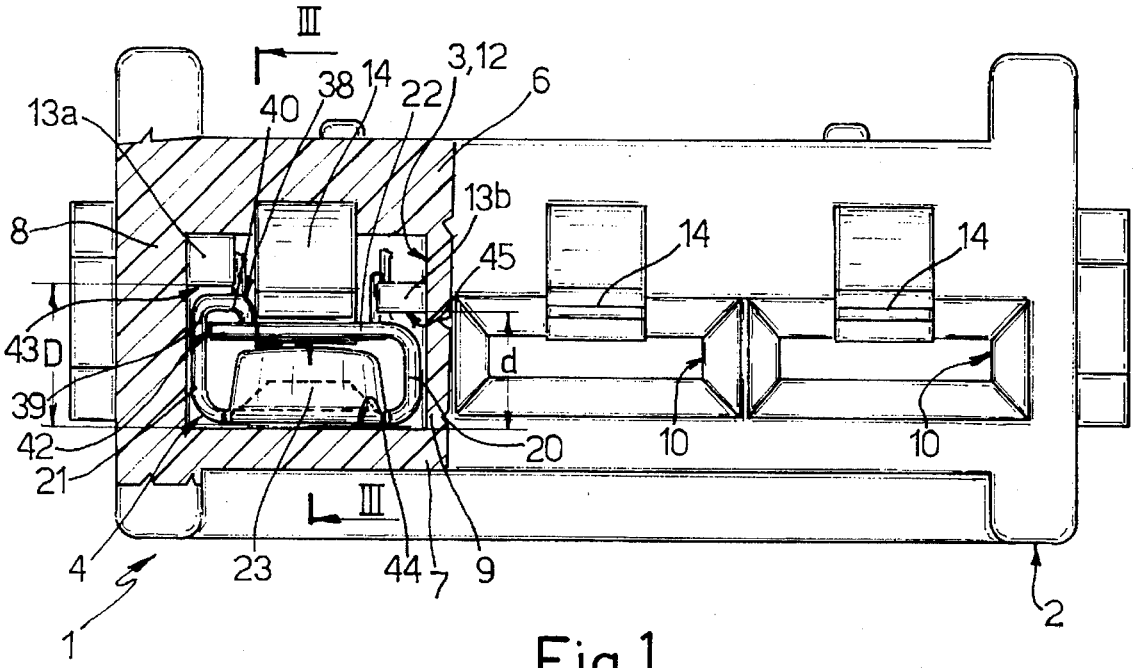
Fig.1
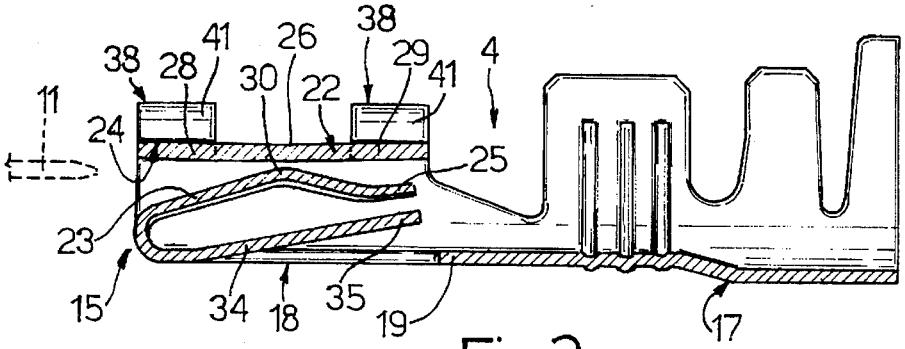
Fig.3
Fig.4
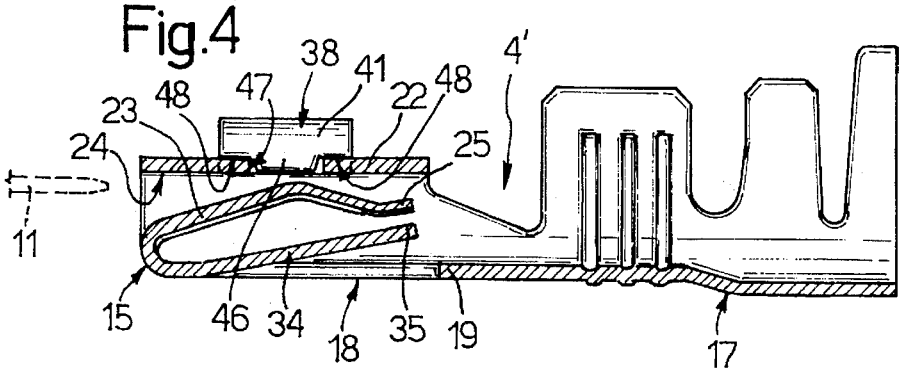

ELECTRIC CONNECTOR

BACKGROUND OF THE INVENTION

The present invention relates to an electric connector, and in particular, an electric connector comprising an insulating outer case defining a number of axial cavities, and a number of electric terminals housed respectively inside the cavities.

Connectors are known featuring electric terminals integrally comprising a deformable portion for connection to a cable, and a box type contact body with a closed rectangular section and a flexible contact blade bent inside the box structure and cooperating with a male blade terminal of a complementary connector.

The box structure of the contact body is formed by bending a flat blank, and presents two adjacent walls mating along one edge of the structure. Electric terminals are known wherein the contact body presents one or more tabs integral with one of the walls and bent onto the other wall to prevent the elastic contact load from "opening" the box structure at the edge.

Connectors are also known wherein the electric terminals present respective so-called polarizing outer teeth or projections permitting insertion of the terminals inside the respective cavities in one predetermined position only, or, in the event of incorrect insertion, cooperating with locating elements provided for the purpose inside the cavities.

SUMMARY OF THE INVENTION

It is an object of the present invention to provide an electric connector featuring terminals with a box structure of the type briefly described above, and wherein polarization is achieved in a particularly straightforward manner with no need for specific additional parts, thus simplifying the production cycle and relative tooling, and preventing any weakening of the box structure of the terminal.

According to the present invention, there is provided an electric connector comprising an insulating case having at least one axial cavity and at least one electric terminal housed inside the cavity. The terminal comprises a deformable portion for connection to a respective electric cable, and a contact body cooperating with a complementary electric terminal and presenting a rectangular-section box structure defined by four lateral walls facing each other in pairs, two of to four walls being adjacent to each other, being separate, and mating with each other substantially along one edge of the box structure. The contact body comprises at least one tab extending integrally from the first of the two walls and bent onto the second of the two walls. The terminal comprises polarizing means cooperating with respective locating means formed in the cavity of the case, for preventing misinsertion of the terminal into the cavity. The locating means comprise a first pair of surfaces and a second pair of surfaces defining two opposite lateral portions of cavity; surfaces in said first pair being separated by a distance at least equal to the total height of the contact body, including the tab, and the surfaces in the second pair being separated by a distance at least equal to the height of the box structure, excluding the tab, the polarizing means of the terminal consisting of the tab.

BRIEF DESCRIPTION OF THE DRAWINGS

A preferred embodiment of the present invention will now be described by way of example with reference to the accompanying drawings, in which:

FIG. 1 is a front view, with parts removed for clarity, of an electric connector in accordance with the present invention;

FIG. 3 is a cross-section view of the FIG. 2 terminal along line III—III in FIG. 1; and FIG. 4 shows a variant of FIG. 3.

DETAILED DESCRIPTION OF THE INVENTION

Figure 2:
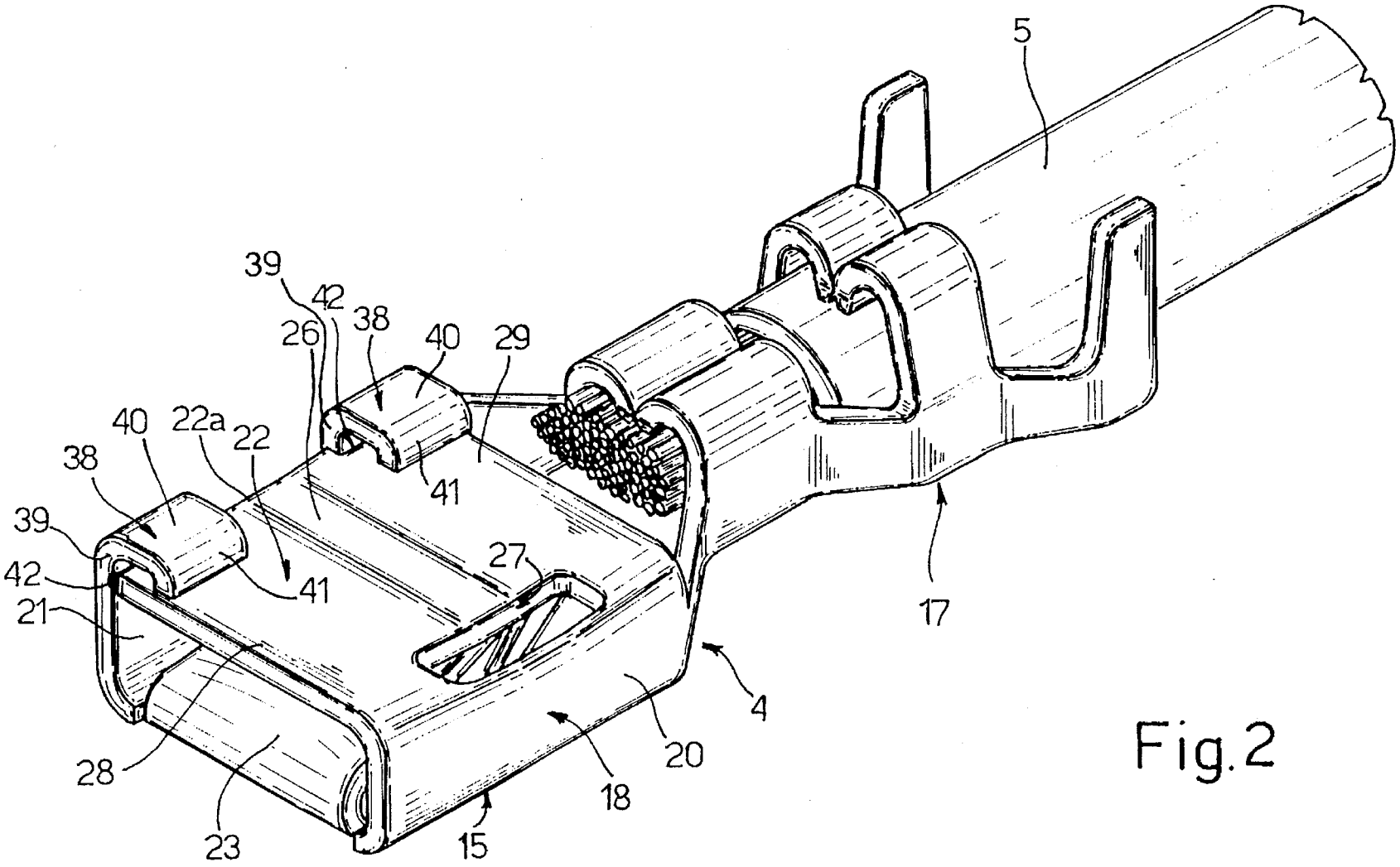
FIG. 2 is a perspective view of an electric terminal of the FIG. 1 connector.

Connector 1 comprises an insulating case 2 defining a number of side-by-side through axial cavities 3, and a number of electric terminals 4 for connection to respective cables 5 and housed inside respective cavities 3.

More specifically, case 2 is molded from thermoplastic material, is substantially in the form of a parallelepipedon, and is defined by a top wall 6, a bottom wall 7 and two lateral walls 8.

Cavities 3 are arranged in one horizontal row, and are separated by vertical longitudinal inner walls 9 of case 2 equally spaced in relation to one another and in relation to lateral walls 8.

Each cavity 3 communicates externally of connector 1 through a front opening 10 permitting insertion of a male electric terminal 11 (shown partially by the dotted line in FIG. 3) forming part of a complementary connector (not shown), and through a rear opening 12 permitting insertion of terminal 4 inside the cavity.

Each cavity 3 presents inner ribs 13*a*, 13*b* (described in more detail later on) for guiding a respective terminal 4, and a flexible retaining element 14 designed to snap onto terminal 4 and lock it inside cavity 3. Element 14 is known and therefore not described in detail.

Terminals 4 (FIG. 2) are formed in one piece from conductive sheet metal by means of blanking, pressing and bending operations.

Each terminal 4 substantially comprises a contact body 15 cooperating with a respective male terminal 11, and a deformable connecting portion 17 for connection to respective electric cable 5.

Contact body 15 comprises a box structure 18 with a substantially closed rectangular section, defined by four lateral walls 19, 20, 21, 22 facing each other in pairs, and a contact blade 23 integral with and bent inside box structure 18.

More specifically, box structure 18 comprises a bottom wall 19, from a rear portion of which connecting portion 17 originates.; two lateral walls 20, 21 bent 90° upwards in relation to bottom wall 19; and a top wall 22 integral with one of the lateral walls (20) and bent in relation to it substantially in a plane parallel to bottom wall 19, so that its free lateral edge 22*a* mates with the top edge of the other lateral wall 21.

Contact body 15 presents a front opening 24 for insertion of male terminal 11.

Flexible contact blade 23 extends integrally from the front portion of bottom wall 19, is bent inside body 15 at front opening 24, and presents a curved longitudinal profile with its convexity facing top wall 22. Blade 23 also presents a free end 25 bent slightly towards top wall 22 and located close to the rear end of body 15.

Top wall 22 (FIG. 2) is shaped, and presents a shallow intermediate transverse trough 26 extending substantially over the whole width of wall 22 from a slot 27 formed close to lateral wall 20 for permitting deformation of wall 22 without puckering or splitting the material. Wall 22 also presents a flat front portion 28 and a flat rear portion 29, both sloping slightly downwards towards, trough 26, which faces an intermediate portion 30 of contact blade 23, and cooperates with male terminal 11 under the contact load transmitted to the terminal by blade 23.

Transversely, blade 23 is conveniently slightly convex (FIG. 3) to reduce the area of the portion contacting male terminal 11.

Contact body 15 also comprises a second flexible reinforcing blade 34 projecting from the front portion of bottom wall 19, and sloping rearwards and inwards of the body so that its free end 35 is located close to and substantially parallel to the free end 25 of blade 23.

From the opposite ends of the top edge of lateral wall 21 of box structure 18, there extend upwards two U-shaped tabs 38, the free ends of which cooperate with top wall 22. More specifically, each tab 38 presents a first portion 39 coplanar with lateral wall 21; a second portion 40 bent 90° and facing and detached from top wall 22; and a third end portion 41 bent further towards, and the end face of which cooperates with, top wall 22. Conveniently, edge 22*a* of wall 22 is superimposed on lateral wall 21, and presents a pair of end recesses 42 cooperating with respective first portions 39 of tabs 38.

With reference to FIG. 1, guide rib 13*a* of terminal 4 is located along a top edge of respective cavity 3, on the side of the cavity receiving the lateral portion of terminal 4 with tabs 38, and is defined at the bottom by a surface 43 separated from the bottom surface 44 of the cavity by a distance (D) at least equal to the total height of contact body 15, including tabs 38. Rib 13*b* is located on the opposite side of cavity 3, and is defined at the bottom by a surface 45 separated from the bottom surface 44 of the cavity by a distance (d) less than the total height of contact body 15, but at least equal to the height of box structure 18, excluding tabs 38.

Consequently, insertion of terminal 4 inside respective cavity 3 is possible only when the terminal is oriented as shown in FIG. 1, and is prevented, when the terminal is turned 180° about its longitudinal axis, because the distance between rib 13*b* and surface 44 is too small to receive the lateral portion of terminal 4 with tabs 38. When correctly inserted, terminals 4 are locked inside the respective cavities by retaining element 14, which snaps against the rear edge of top wall 22.

When a male terminal 11 is inserted inside contact body 15 through a respective front opening 10 in case 2, it penetrates between contact blade 23 and portion 28 of top wall 22, the slight inclination of which portion 28 assists in vertically centering the terminal, and the insertion of terminal 11 flexes contact blade 23 towards reinforcing blade 34, which remains idle until its free end 35 is contacted by the free end 25 of blade 23.

As terminal 11 is inserted further, blades 23 and 34 flex jointly, and the rigidity of blade 34 provides for increasing the contact pressure exerted by blade 23 on terminal 11.

The contact pressure exerted by blades 23 and 34 is transmitted to top wall 22, but tabs 38, cooperating with wall 22, prevent it from flexing upwards and so "opening" box structure 18.

FIG. 4 shows a terminal 4' according to a variation of the present invention, which will be described only insofar as it differs from terminal 4 in FIG. 2.

Terminal 4' comprises only one tab 38 extending from an intermediate portion of wall 21, bent in a U as already described, and presenting a trapezoidal end tooth 46 engaging a recess 47 in top wall 22 of box structure 18, while respective lateral portions 48 of the end edge of tab 38 cooperate with wall 22.

As such, in addition to preventing wall 22 from flexing upwards, tab 38 also prevents top wall 22 and lateral wall 21 from parting horizontally, due, for example, to pressures flexing lateral walls 20 and 21 outwards.

The structural resistance of the box structure is thus further enhanced.

In addition to performing the structural function described above, tabs 38 also provide for polarizing terminals 4 with no need for forming specific polarizing portions, such as additional projections or teeth, on terminals 4. This simplifies the production cycle and tooling for manufacturing terminals 4, as well as for strengthening box structure 18 by avoiding mechanical machining, e.g., partial blanking, for forming specific polarizing portions.

Moreover, by virtue of being substantially U-shaped with no sharp outer edges, tabs 38 provide for smooth, troublefree insertion of terminals 4 inside respective cavities 3 with no jamming.

Finally, the design of top wall 22 enhances the rigidity of box structure 18 and assist the insertion of male terminal 11.

I claim:

1. An electric connector comprising an insulating case having at least one axial cavity and at least one electric terminal housed inside said cavity, said terminal comprising (a) a deformable portion for connection to an electric cable; and (b) a contact body cooperating with a complementary electric terminal and having a rectangular-section box structure defined by four lateral walls facing each other in pairs, two of said four walls being adjacent to each other, being separate, and mating with each other substantially along one edge of said box structure;

(c) at least one tab extending integrally from a first of said two walls and bent onto a second of said two walls;

(d) polarizing means cooperating with respective locating means formed in said cavity of said case for preventing misinsertion of said terminal inside said at least one cavity, said locating means comprising a first pair of surfaces and a second pair of surfaces defining two opposite lateral portions of said cavity, said surfaces in said first pair being separated by a distance at least equal to a total height of said contact body, including said at least one tab, and said surfaces in said second pair being separated by a distance at least equal to a height of said box structure, excluding said at least one tab;

(e) wherein said polarizing means of said terminal is constituted by said at least one tab.

2. A connector as claimed in claim 1, wherein said at least one tab is U-shaped and comprises a first portion substantially coplanar with said first wall, a second portion facing and detached from said second wall, and a third portion bent toward said second wall.

3. A connector as claimed in claim 2, wherein an end face of said third portion of said at least one tab cooperates with said second wall.

4. A connector as claimed in claim 2, wherein said at least one tab is provided with an end tooth engaging a recess formed in said second wall.

5. A connector as claimed in claim 1, comprising two said tabs extending from opposite longitudinal ends of said first wall.

6. A connector as claimed in claim 1, wherein said contact body comprises at least one flexible contact blade bent inside said box structure, said second wall having a trough facing an intermediate portion of said contact blade.

7. A connector as claimed in claim 6, wherein said trough extends over substantially an entire width of said second wall from a slot formed in said second wall close to one of said lateral walls integral with said second wall.

8. A connector as claimed in claim 6, wherein said second wall comprises a flat front portion and a flat rear portion, both sloping slightly towards said trough.

* * * * *